US006113372A

United States Patent [19]

Lifson et al.

[11] Patent Number: 6,113,372

[45] Date of Patent: Sep. 5, 2000

[54] SCROLL COMPRESSOR WITH DISCHARGE CHAMBER GROOVE

[75] Inventors: Alexander Lifson, Manlius; James W. Bush, Skaneateles, both of N.Y.

[73] Assignee: Carrier Corporation, Farmington, Conn.

[21] Appl. No.: 09/274,604

[22] Filed: Mar. 23, 1999

Related U.S. Application Data

[60] Provisional application No. 60/096,969, Aug. 18, 1998.

[51] Int. Cl.[7] ..... F01C 1/02

[52] U.S. Cl. ..... 418/55.1; 418/55.2

[58] Field of Search ..... 418/55.1, 55.2

[56] References Cited

U.S. PATENT DOCUMENTS 4,645,437 2/1987 Sakashita et al. ..... 418/55.5
4,992,032 2/1991 Barito et al. ..... 418/55.4
5,069,605 12/1991 Saitoh et al. ..... 418/55.2
5,370,512 12/1994 Fujitani et al. ..... 418/55.2
5,427,513 6/1995 Yamada et al. ..... 418/55.2

*Primary Examiner*—Thomas Denion
*Assistant Examiner*—Theresa Trieu
*Attorney, Agent, or Firm*—Howard & Howard

[57] ABSTRACT

A groove is formed in the base of a scroll member, and has an end communicating with a discharge port. A portion of the groove also communicates with one or both intermediate compression chambers at a point just before the compression chambers begins to communicate with the discharge port. This allows for a gradual equalization of pressure in the intermediate compression chambers and compressor discharge just before porting. This results in reduction of unwanted compressor noise. Further, once the chambers have communicated with the discharge port, the groove continues to provide additional flow passages to the discharge port, thus decreasing throttling flow loses through the compressor port.

7 Claims, 3 Drawing Sheets

SCROLL COMPRESSOR WITH DISCHARGE CHAMBER GROOVE

This application claims priority to provisional patent application Ser. No. 60/096,969, filed Aug. 18, 1998.

BACKGROUND OF THE INVENTION

This invention relates to a scroll compressor with a groove which assists in communicating a compression pocket to the discharge port.

Scroll compressors are becoming widely utilized for refrigerant compression applications. As known, interfitting orbiting and non-orbiting scroll wraps define a plurality of compression chambers. Typically, two compression chambers are concurrently sealed to move through intermediate pressures to a discharge port. The compression chambers eventually communicate with the discharge port. When the compression chambers communicate with the discharge port, the pressure in the compression chambers can be lower than pressure in the discharge. Under these conditions the refrigerant abruptly re-expands back into the compression chambers. This has sometimes resulted in undesirable noise.

At the beginning of the discharge process the port opening is small, while the flow rate out of the compression chamber is the highest. This results in large flow losses and resulting efficiency drop.

Grooves have been formed in the bases of scroll members for several purposes. One known groove is disclosed in U.S. Pat. No. 08/967040, filed Nov. 3, 1997, and entitled "Scroll Compressor with Pressure Equalization Groove." Further, U.S. Pat. No. 5,762,483 discloses a groove in the base plate of the scroll members. These grooves, however, have not fully addressed the above problems.

SUMMARY OF THE INVENTION

In a disclosed embodiment of this invention, a groove is located on the floor of one or both of the scroll compressor pump bases, The groove can also be located on the tips of fixed or orbiting scroll. One end of the groove preferably communicates with the discharge port. Another portion of the groove is placed at a position such that it will communicate with one or two intermediate compression pockets near the end of the compression cycle.

Stated another way, the groove is positioned such that it will begin communication between the intermediate compression pocket or pockets and the discharge port just before the two intermediate compression pockets merge into a single discharge chamber.

At that time of the communication, the refrigerant is allowed to pass from the discharge chamber directly into or out of the intermediate chamber through the groove. This allows the fluid to re-expand gradually. Preferably, this point is selected to be just before the entire compression chamber begins to communicate with the discharge port. This gradual re-expansion reduces compressor noise.

As the orbiting scroll continues to move, eventually, the intermediate compression chamber begins to open to the discharge port. However, at that time the groove is still providing additional benefits of having a larger opening to the flow being discharged from compression chambers. Thus, compression efficiency is improved.

This additional reduction in flow loss occurs at a point when the reduction in flow loss is most beneficial. That is, the additional passage is functioning when the port opening is otherwise small, and when the volume flow rate through the discharge port is high.

These and other features of the present invention can be best understood from the following specification and drawings, of which the following is a brief description.

DETAILED DESCRIPTION OF THE PREFERRED EMBODIMENT

Figure 2:
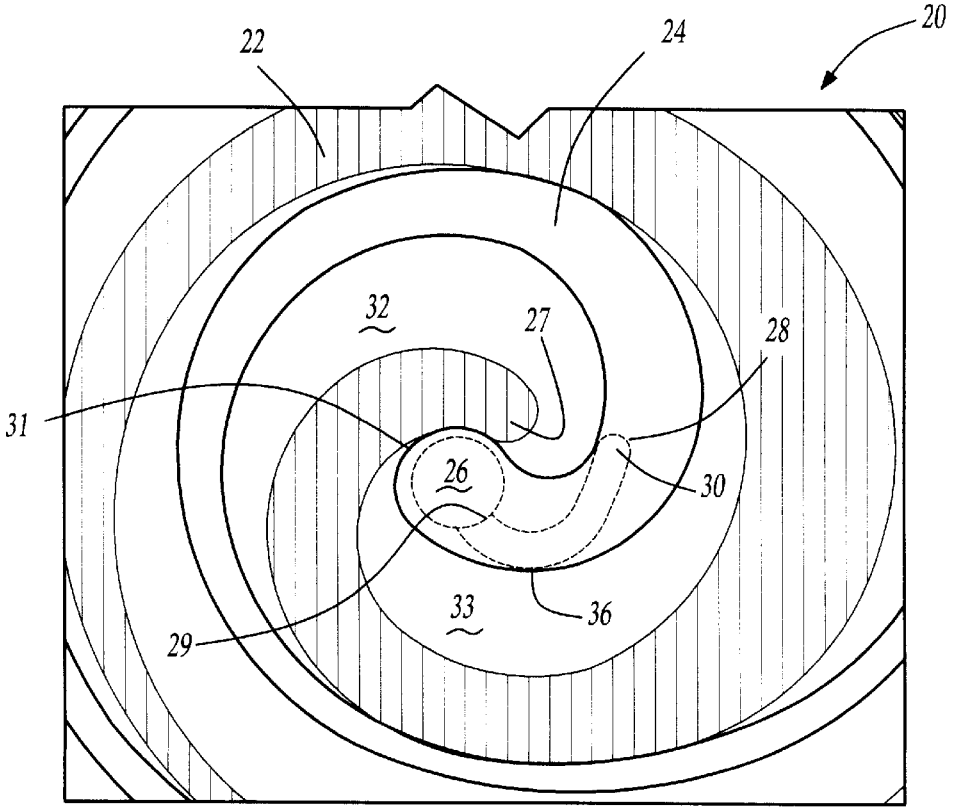
FIG. 2 shows a scroll compressor wraps in a first position.
Figure 3:
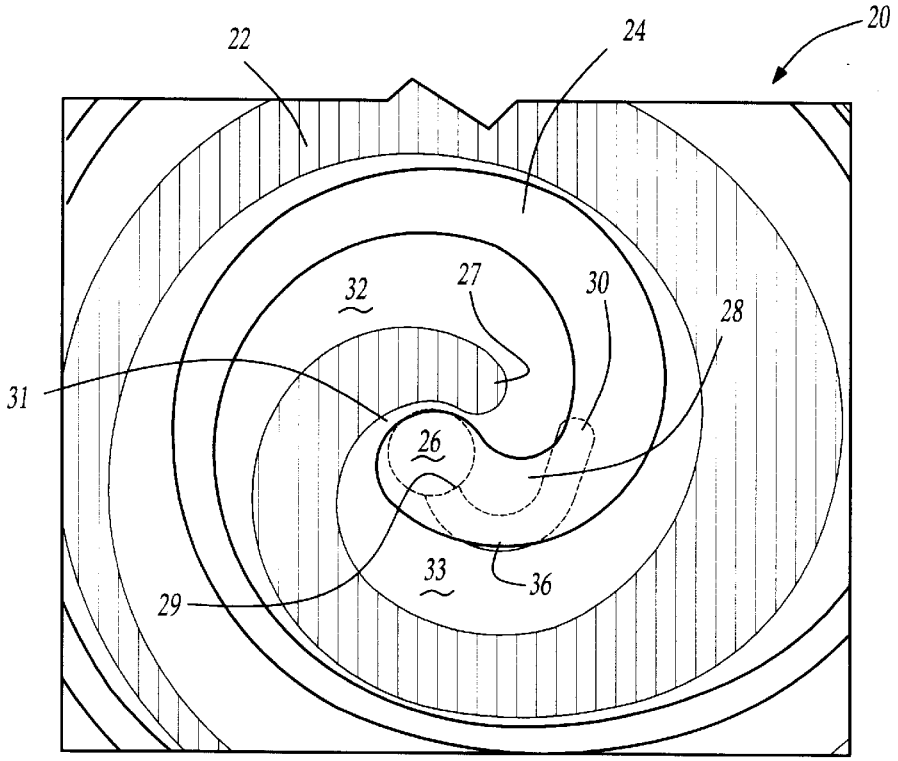
FIG. 3 shows a scroll compressor wraps in a position subsequent to that of FIG. 2.
Figure 4:
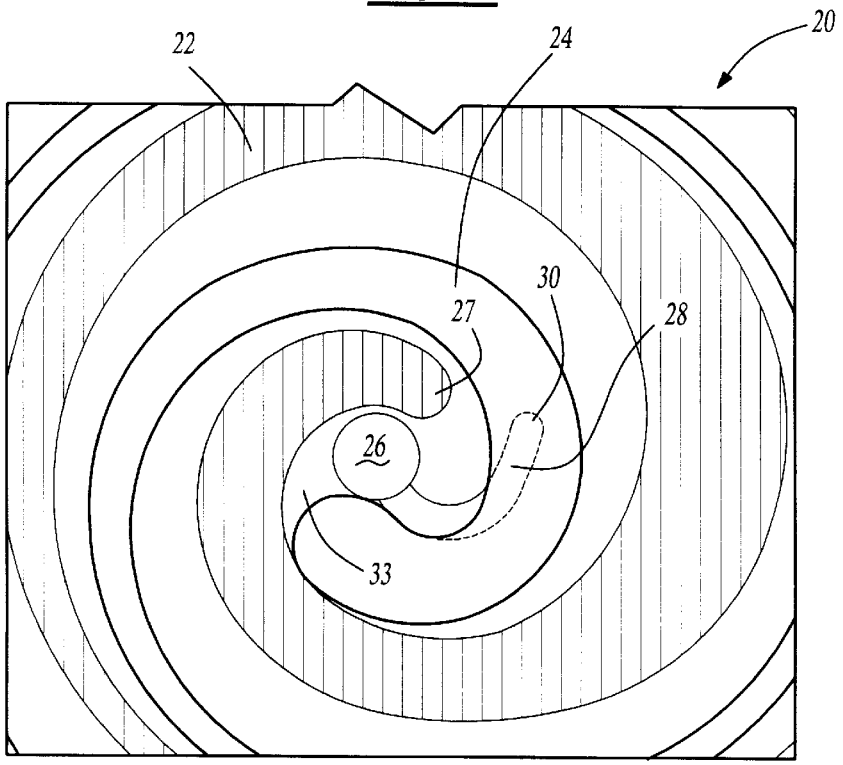
FIG. 4 shows a scroll compressor wraps in a position subsequent to FIG. 3.

Scroll compressor elements are shown in FIGS. 2, 3 and 4 at three points in the cycle. It should be understood that the cycle moves from FIG. 2 to FIG. 3 and then to FIG. 4. From FIG. 4, the cycle returns to FIG. 2.

Figure 1:
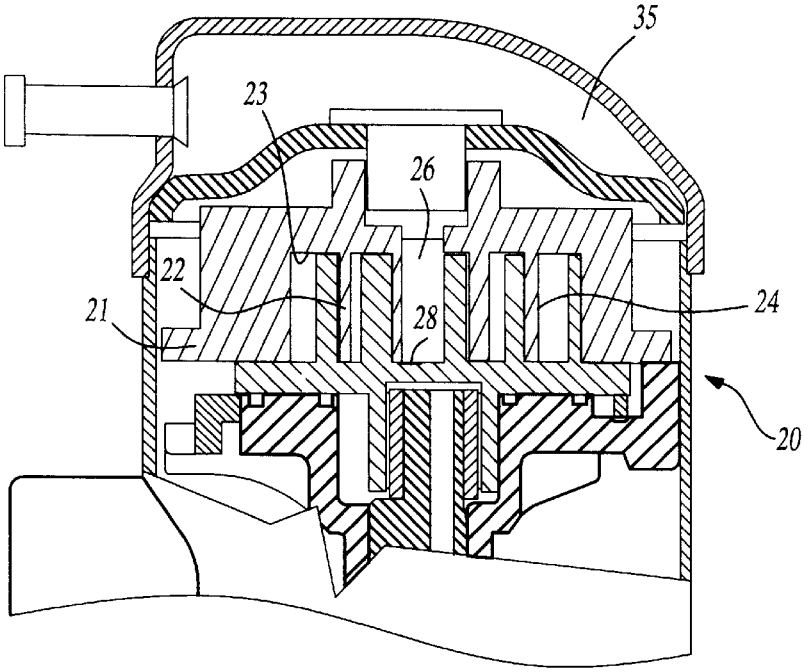
FIG. 1 shows an upper portion of a scroll compressor.

As shown in FIG. 1, the scroll compressor 20 includes a non-orbiting, scroll member 21 having a base 23. A spiral wrap 22 extends outwardly from base 23 as known. An orbiting scroll wrap 24 interfits with wrap 22, again as known. A discharge port 26 is formed in the base 23. There is a discharge muffler space 35, which is exposed to compressor discharge pressure.

As shown in FIG. 2, port 26 is adjacent to an inner portion 27 of wrap 22. A groove 28 has a first end 29 communicating with discharge port 26 and an opposed second end 30 spaced from the discharge port 26. A groove 28 is shown to be located in a fixed scroll, but is not limited to fixed scroll members. An inner portion 31 of orbiting scroll wrap 24 is illustrated at the end of the compression cycle in the position shown in FIG. 2, and abuts inner portion 27 of fixed scroll wrap 22.

In this position, the discharge port 26 and the entire groove 28 are covered by the orbiting scroll wrap. A pair of intermediate compression pockets 32 and 33 are shown, which will soon begin to communicate with the discharge port 26 as the orbiting scroll 24 continues to move. Although details of the orbiting and non-orbiting scroll are not shown, those details are well within the skill of a worker in the art.

As shown in FIG. 3, the orbiting scroll has now moved slightly from the position shown in FIG. 2. Tip 30 of groove 28 now communicates with chamber 32 and tip 36 now communicates with chamber 33. Fluid at discharge pressure in muffler space 35 is now connected through groove 28 to the intermediate chamber 32 and 33. Thus, fluid in the muffler space 35 will begin to gradually re-expand into or out of intermediate chambers 32 and 33. This will reduce the noise that otherwise occurs if the fluid would have been allowed to re-expand rapidly.

As the orbiting scroll moves from the FIG. 3 position to the FIG. 4 position, the port 26 begins to be uncovered by the orbiting scroll position immediately following the position shown in FIG. 3. However, the port opening is still small and the additional flow area provided by the groove assists in increasing effective area for the flow to move out of port 28. As shown in FIG. 4, the orbiting scroll 24 has now moved to the fully opened port position. As the scroll wrap 24 continues to move from the FIG. 4 position, it will soon move back to the FIG. 2 position.

In summary, the addition of the groove 28 assists the porting of the intermediate chambers to the discharge port at the appropriate time. This reduces noise and flow losses.

A groove according to this application may have a depth of between 100 microns and 10 millimeters. Further, while the groove is described as being in the fixed scroll, it may also be that the member 24 is the wrap of a non-orbiting scroll and the member 22 and 23 is the orbiting scroll wrap and the orbiting scroll baseplate, respectively. In such a case, the orbiting scroll movement would still be relative to the discharge port, and the groove would still open and close by being moved over the non-orbiting scroll wrap.

Further, the groove may be formed in the orbiting scroll or fixed scroll wrap tips.

Figure 5:
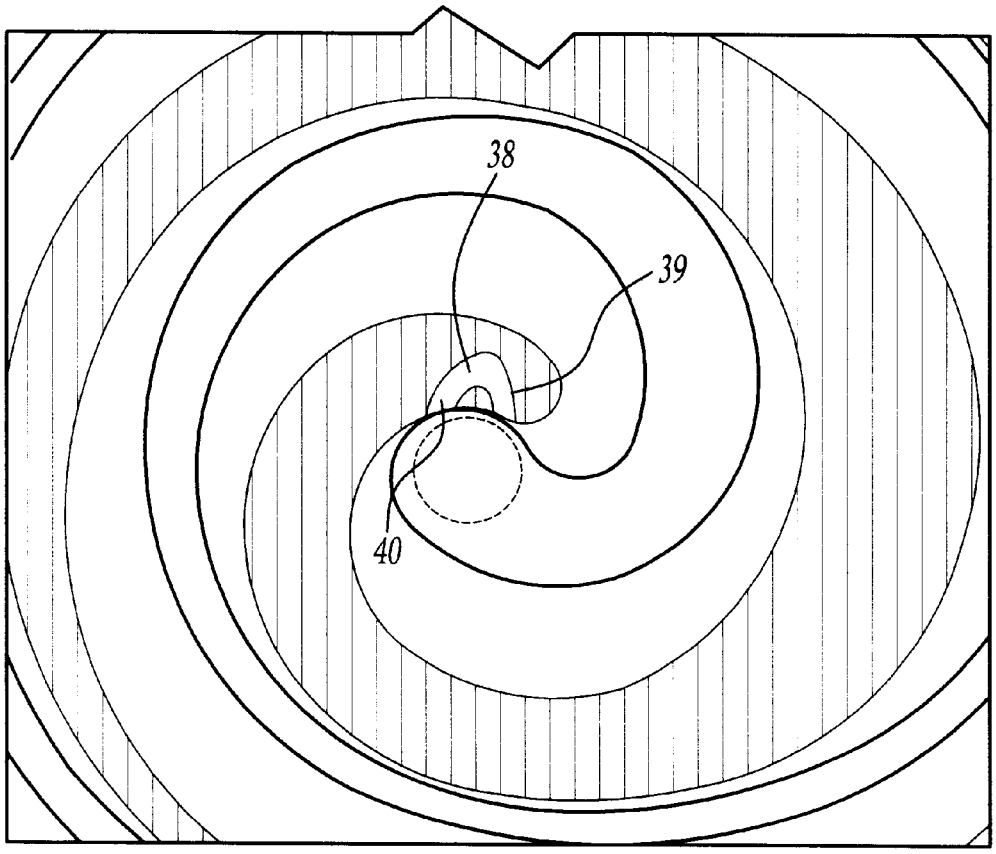
FIG. 5 shows another embodiment.

FIG. 5 shows an embodiment wherein a groove 38 is formed in the tip of the fixed scroll wrap. It should be understood that the groove could also be formed into the tip of the orbiting scroll wrap, and that the invention would extend to such an embodiment. One end 39 of the groove 38 extends to the discharge port 26. Another portion 40 of the groove 38 starts to open to intermediate pressure chamber just prior to porting. As such, the groove 38 performs the functions as set forth above.

A worker of ordinary skill in the art would recognize that certain modifications would come within the scope of this invention. For that reason, the following claims should be studied to determine the true scope and content of this invention.

What is claimed is:

1. A scroll compressor comprising:

a first scroll having a base and a spiral wrap extending from said base;

a second scroll having a base and a spiral wrap extending from said base, said wraps of said first and second scrolls interfitting, said second scroll being driven for orbital movement relevant to said first scroll such that said wraps of said first and second scroll cyclically interact with each other to define seal points separating compression chambers, movement of said second scroll wrap moving said compression chambers inwardly to communicate with a central discharge port, at least two of said compression chambers being moved toward said discharge port concurrently, said at least two compression chambers eventually communicating with each other and said discharge port; and a discharge porting groove formed in at least one of said first and second scrolls, wherein an end of the groove communicates with said discharge port and a portion of said grooves selectively communicate with one or both of said compression chambers at a location just before said one or both of said compression chambers begins to communicate with said discharge port.

2. A scroll compressor as recited in claim 1, wherein said groove is formed in the base of said at least one of said first and second scrolls.

3. A scroll compressor as recited in claim 2, wherein said groove is formed in said base of said first scroll.

4. A scroll compressor as recited in claim 2, wherein said groove is formed of a depth of between 100 microns and 10 millimeters.

5. A scroll compressor as recited in claim 1, wherein said groove assists in providing gradual pressure equalization in said one compression chamber, and further supplies additional flow passage area during porting.

6. A scroll compressor as recited in claim 1, wherein said groove is formed in said wrap of at least one of said first and second scrolls.

7. A scroll compressor as recited in claim 6, wherein said groove is formed in said wrap of said first scroll.

* * * * *